US012358753B2

(12) United States Patent
McQuade

(10) Patent No.: US 12,358,753 B2
(45) Date of Patent: Jul. 15, 2025

(54) ELASTIC SPOOL PROTECTOR

(71) Applicant: Kyle T. McQuade, Newark, OH (US)

(72) Inventor: Kyle T. McQuade, Newark, OH (US)

( * ) Notice: Subject to any disclaimer, the term of this patent is extended or adjusted under 35 U.S.C. 154(b) by 0 days.

(21) Appl. No.: 18/185,889

(22) Filed: Mar. 17, 2023

(65) Prior Publication Data

US 2023/0303361 A1 Sep. 28, 2023

Related U.S. Application Data

(60) Provisional application No. 63/324,521, filed on Mar. 28, 2022.

(51) Int. Cl.
*B65H 75/00* (2006.01)
*B65H 75/18* (2006.01)

(52) U.S. Cl.
CPC ..... *B65H 75/005* (2013.01); *B65H 75/187* (2013.01)

(58) Field of Classification Search
CPC .. B65H 75/005; B65H 75/141; B65H 75/145; B65H 75/187; B65H 75/14; B65H 75/185; B65H 2701/5136
USPC ..... 242/601, 614, 614.1
See application file for complete search history.

(56) References Cited

U.S. PATENT DOCUMENTS 1,448,355 A * 3/1923 Bowen ..... D02H 13/28 242/607
1,753,342 A * 4/1930 Hubbard ..... B65H 75/14 242/118.6
2,529,420 A * 11/1950 Ramquist ..... B65H 75/2281 411/509
2,617,609 A * 11/1952 Andrews ..... B65D 85/672 242/614
3,819,124 A * 6/1974 Marks ..... G11B 23/037 242/610.4
4,819,892 A * 4/1989 Schurmann ..... B65H 75/18 242/476.2
5,553,810 A * 9/1996 Bobeczko ..... B65H 75/141 206/402
5,794,882 A * 8/1998 Lewis ..... A47K 10/38 242/423.1
6,199,786 B1 3/2001 Lessard et al.
6,478,249 B1 * 11/2002 Orzel ..... B65H 75/14 242/607
7,523,883 B2 4/2009 Cheng
(Continued)

FOREIGN PATENT DOCUMENTS

EP 0896363 A2 * 10/1999 ..... H01L 21/00
GB 2490350 A * 10/2012 ..... B66D 1/30
KR 20130000078 U * 1/2013 ..... B23K 9/124

*Primary Examiner* — Anna M Momper
*Assistant Examiner* — Nathaniel L Adams
(74) *Attorney, Agent, or Firm* — Standley Law Group LLP; Jeffrey S. Standley; Bryan P. Finneran

(57) ABSTRACT

A device is provided for protecting a spool, such as, for example, a wire reel. An example of the device is useful for both preventing damage to spools and permitting damaged spools to be continued to be used. The elastic spool protector may include a disk-shaped member and a rim portion. In one example, an elastic spool protector is capable of being positioned on a flange of a wire reel. In one example, and an edge region of a flange may be received between a main portion and a lip portion of the elastic spool protector. The elastic spool protector may include one or more of various elastomeric materials.

4 Claims, 10 Drawing Sheets

(56) References Cited

U.S. PATENT DOCUMENTS

| | | | | |
|---|---|---|---|---|
| 10,047,533 | B2 | 8/2018 | Nakagawa et al. | |
| 10,407,265 | B1 * | 9/2019 | Liles | B65H 75/141 |
| 2003/0098385 | A1 * | 5/2003 | Back | B65H 75/141<br>242/597 |

* cited by examiner

ELASTIC SPOOL PROTECTOR

CROSS-REFERENCE TO RELATED APPLICATIONS

This application claims priority to U.S. Provisional Application No. 63/324,521, filed on Mar. 28, 2022, hereby incorporated by reference in its entirety as if fully recited herein.

TECHNICAL FIELD

Embodiments of the present disclosure relate to a device and its corresponding method for protecting spools (e.g., wire reels) from damage and/or permitting damaged spools to be continued to be used. In one example embodiment, an elastic spool protector is adapted to be positioned on a flange of a spool. The elastic spool protector may include a main portion and a flange grip portion (also referred to herein as a "lip portion"), wherein a receptacle between the main portion and the flange grip portion may be configured to receive an edge portion of a flange. The elastic wire reel protector may comprise any number of different elastomeric materials preferably having a high friction coefficient.

BACKGROUND AND SUMMARY OF THE INVENTION

Spools including, for example, wire reels (may also be referred to as "wire spools," "cable reels," "cable spools," and the like) are well known in the art for permitting reeled, spooled, coiled, or otherwise wound material to be transported, repositioned, length adjusted, and the like. Said material may include, for example, electrical wire, fiber optic cables, other windable material, some combination thereof, or the like. A spool is not necessarily limited to use with wire. A spool may comprise a spool drum or core positioned between a first flange and a second flange. The spool drum and flanges may comprise plastic material. Additional spool components such as, for example, guide rollers, guide arms, return coil springs, grooves, other track functioning components, some combination thereof, or the like may also be employed (said components are outside the scope of the present invention). Reusable spools may often be desired to, for example, reduce spool production costs, reduce solid waste related to discarded spools, permit manufacturers to supply coils of wire and/or other windable material initially unmounted to spools (e.g., wire reels), some combination thereof, or the like.

A major issue with known spools includes that said spools are largely susceptible to cracking, breaking, snapping, bending, or otherwise suffering damage. As a non-limiting example, as wire is unwound from a wire reel and tension is applied thereto, the wire may apply significant force on a surface of a flange, causing the flange to crack, break, snap, bend, some combination thereof, or the like. A damaged flange may limit the ability of the wire reel to be subsequently used for effective wire transport, wire length adjustment, wire repositioning, and the like. Cracks and/or breaks in a spool may, for example, damage or strip portions of material being wound to or unwound from the spool as said material comes into contact with said cracks and/or breaks. Damaged wire and related material may be difficult to fix after being damaged or stripped by cracks and/or breaks in a spool. Tape may be used to repair damaged wire, but tape may provide only limited repair effectiveness. Damaged flanges (as well as other portions of the spool) may also be difficult and/or expensive to fix. A known method to repair a damaged flange includes the use of tape, but tape may be inadequate for effective long-term repair. Thus, in many cases, replacement of damaged spools becomes a preferred option.

Wire or other material from a damaged spool may sometimes be removed from the damaged spool and positioned on a new spool, but doing so may be time consuming and may cost essentially the same as purchasing a new spool with new wire or other material already positioned thereon. Thus, in many cases, both a damaged spool and wire or other material positioned thereon (regardless of whether said wire or other material is also damaged or not) are collectively discarded when the spool becomes damaged. Spool production costs, solid waste related to discarded spools (and, e.g., wire or other material positioned thereon), spool user replacement efforts and/or expenses for new spools, and the like may each be higher than optimal as a result of known spools being largely susceptible to suffering damage.

The aforementioned shortcomings speak to the need for a device that reinforces and protects a spool.

In view of this, it is beneficial to have an elastic spool protector adapted to be positioned on any number of different flanges or like components of any number of different spools.

An exemplary embodiment of the present invention provides an elastic spool protector device, the elastic spool protector configured to be both readily positioned on and readily removed from a flange of a spool.

According to the present invention in one aspect, an exemplary spool protector includes a substantially disc-shaped member, and a curved rim portion extending around an entire perimeter of the disk-shaped member, forming an outer extent of the disk-shaped member. The rim portion may be configured to fit over a flange of a spool (e.g., wire reel). The disc-shaped member may be made of an elastomeric material. The rim portion may also be made of an elastomeric material. The disc-shaped member and the rim portion may comprise a single structural unit. The rim portion may be configured to extend entirely around the circumference of the flange of the spool. The disk-shaped member may include a center opening. The center opening may be configured to receive an arbor of a spool. The disk-shaped member and rim portion may each be capable of covering and reinforcing damaged portions of the flange. The rim portion may be positioned to avoid contact with material surrounding a spool drum proximate to the flange.

According to the present invention in another aspect, a method for assembling a spool protector may comprise providing a substantially disc-shaped member, providing a curved rim portion extending around an entire perimeter of the disc-shaped member (forming an outer extent of the disc-shaped member), and configuring the rim portion to fit over a flange of a spool. The method may further include configuring the rim portion and the disc-shaped member to form a single structural unit made of an elastomeric material. The method may also include configuring the curved rim portion to extend entirely around the circumference of the flange of the spool. The method may additionally include providing a center opening on the disc-shaped member. The rim portion may be positioned to avoid contact with material surrounding a spool drum proximate to the flange.

With an exemplary embodiment of the present invention, wire reels and/or other spools may be protected from suffering impact damage, damaged wire reels and/or other spools may become adapted for continued use, some combination thereof, or the like. As a result, time, labor, material, and/or monetary costs to spool users and/or manufacturers may be reduced by an exemplary embodiment. Additional advantages will become apparent to those of ordinary skill in the art based on the drawings and detailed description thereof.

BRIEF DESCRIPTION OF THE DRAWINGS

Novel features and advantages of the present invention, in addition to those expressly mentioned herein, will become apparent to those skilled in the art from a reading of the following detailed description in conjunction with the accompanying drawings. The present disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein may be made without departing from the scope and spirit of the present invention. In addition, descriptions of well-known functions and constructions are omitted for clarity and conciseness.

Figure 1:
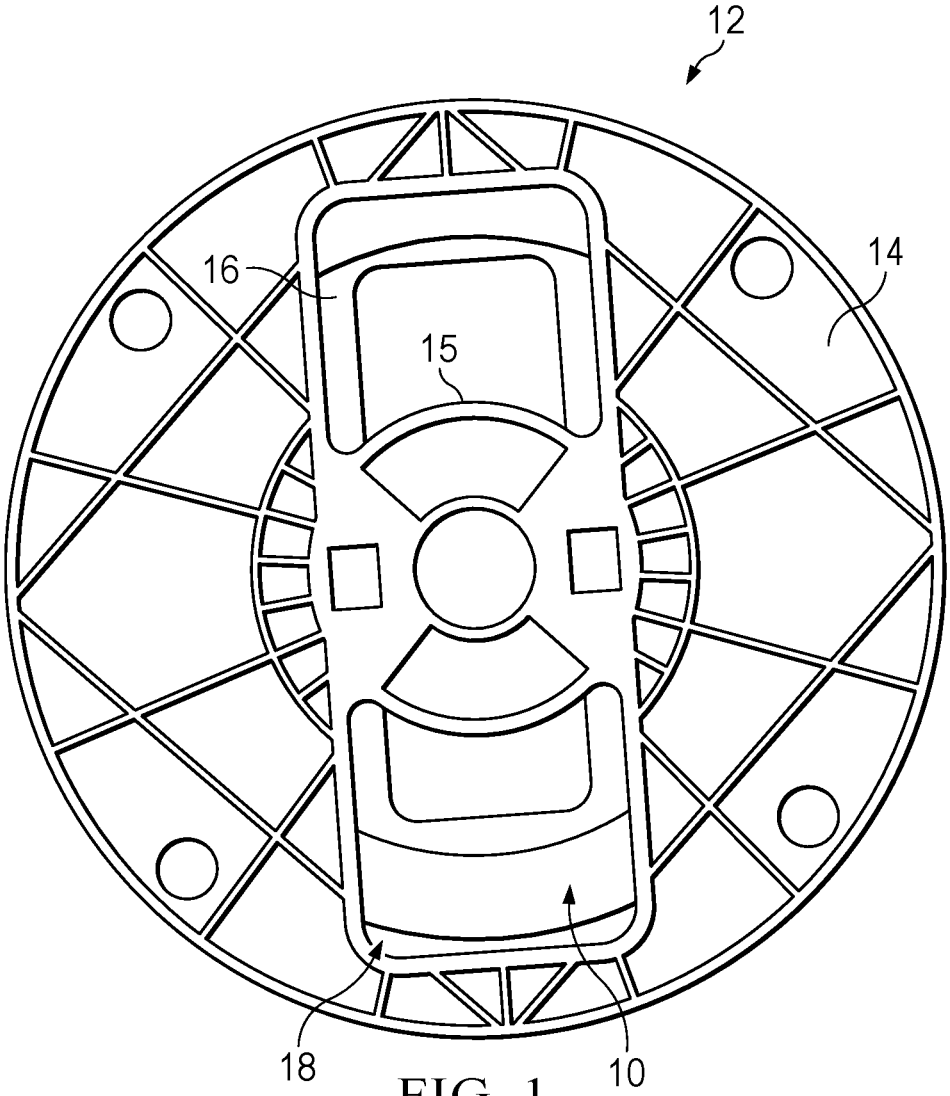
FIG. 1 is a rear perspective view of an exemplary elastic spool protector positioned on a wire reel in accordance with an exemplary embodiment of the present invention.
Figure 2:
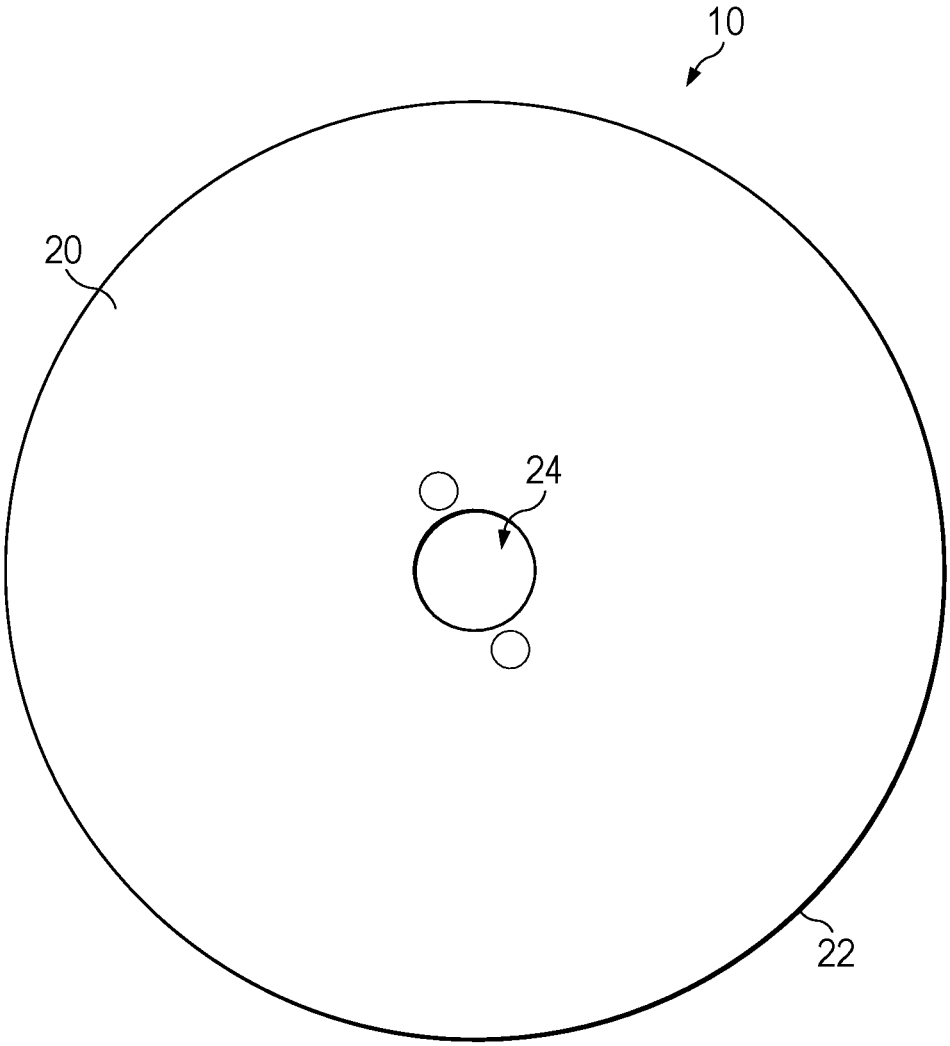
FIG. 2 is a front view of the exemplary elastic spool protector of the FIG. 1 embodiment.
Figure 3:
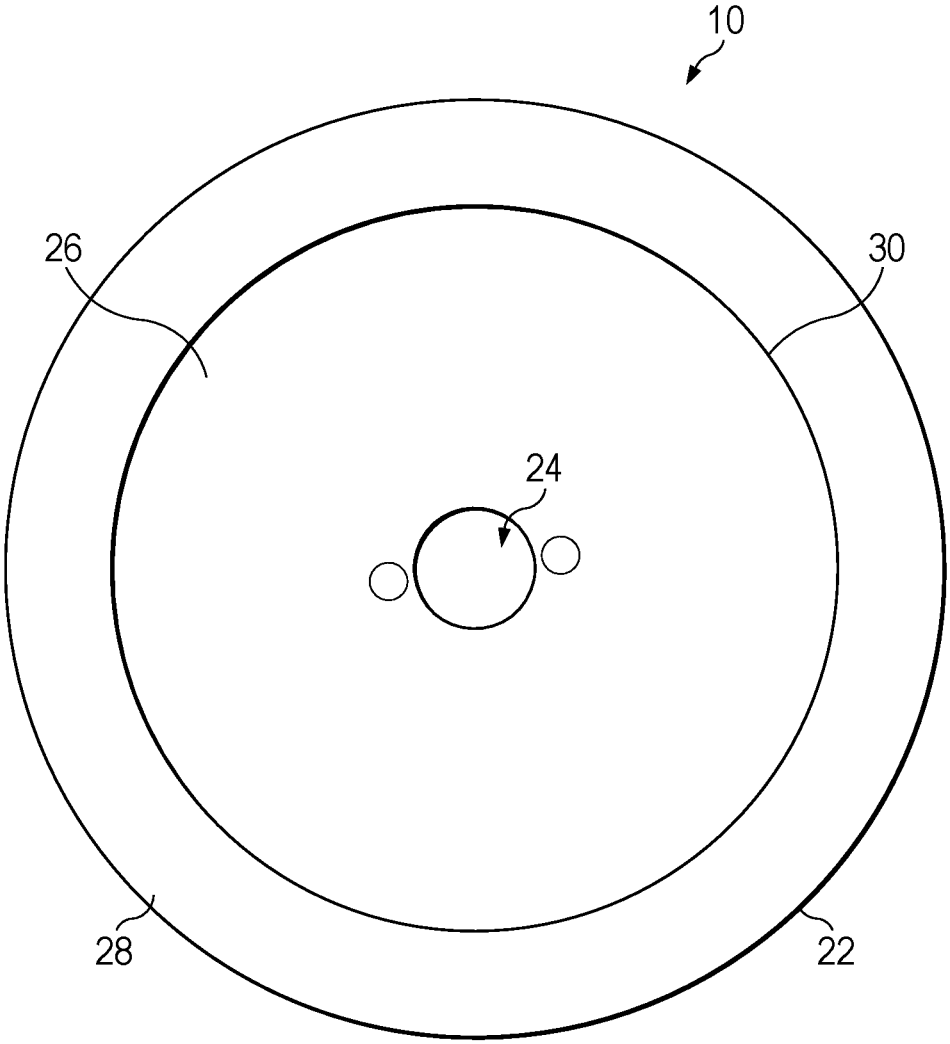
FIG. 3 is a rear view of the exemplary elastic spool protector of the FIG. 2 embodiment.

Referring now to FIG. 1, an exemplary spool protector 10 is shown positioned on a wire reel 12. In this particular embodiment, the wire reel 12 includes a spool drum 15 positioned between a first flange 14 on a right side thereof, and a second flange 16 on a left side thereof. Each flange 14, 16 may include a number of apertures 18. The apertures 18 may reduce the overall weight of the wire reel 12, permit wire and/or other material to be positioned therethrough, may increase rolling capacity of the wire reel 12, some combination thereof, or the like. The flanges 14, 16 and drum 15 of the wire reel 12 may each comprise plastic, although such is not necessarily required. Here, the exemplary spool protector 10 is positioned over a perimeter of the second flange 16, and the first flange 14 does not include an exemplary spool protector. It will be apparent to one of ordinary skill in the art that wire reels shown and described herein are merely illustrative, and are in no way exhaustive of the scope of the present invention. Any number of different spools of any number of different shapes and/or sizes may be employed without necessarily departing from the scope of the present invention.

Without an exemplary spool protector, the first flange 14 may be susceptible to cracking, fracturing, breaking, bending, snapping, some combination thereof, or the like (e.g., resulting from force in material unwound from the wire reel acting on the first flange 14). A portion of the first flange 14 between an outer perimeter of the first flange 14 and an aperture 18 may be particularly susceptible to damage due to the thinness and lack of reinforcing material for said portion. Thus, it may be advantageous to provide reinforcing material to said portion by way of an exemplary elastic spool protector configured to substantially cover said portion. Although FIG. 1 illustrates one flange having an exemplary elastic spool protector linked thereto, in other exemplary embodiments, each flange of a wire reel may be linked to a respective exemplary elastic spool protector to protect and reinforce all flanges (e.g., protection from impact damage).

Exemplary elastomeric material of an elastic spool protector 10 may comprise any number of different flexible materials collectively providing a high friction coefficient (e.g., for immobilization of the protector 10 on the flange 16) without limiting the ability of the elastic spool protector 10 to be readily removed from the flange 16. By way of example and not limitation, rubber, silicone, latex, soft plastic, other flexible 3D-printable filaments, some combination thereof, or the like may define an exemplary elastic spool protector 10. Exemplary elastomeric material may be affordable, and manufacturing of an exemplary elastic spool protector may be streamlined according to 3D-printing, other additive manufacturing techniques, injection molding, some combination thereof, or the like.

The elastic spool protector 10 may be stretched over a perimeter of the flange 16 and may constrict around the perimeter to cover an outer portion of the flange 16. The elastic spool protector 10 may reinforce the wire reel 12, preventing cracks and or breaks (e.g., resulting from force applied by a wire) from forming in the flange 16. Alternatively, or additionally, the elastic spool protector 10 may permit continued use of an already damaged flange (not shown) by covering cracked and/or broken portions thereof, and providing reinforcement thereto. Thus, an exemplary elastic spool protector (e.g., 10) may reduce waste resulting from scrapped wire reels. It will be apparent to one of ordinary skill in the art that an exemplary elastic spool protector may be positioned on and/or removed from any number of different wire reels, other spools, other flange-comprising apparatuses, and the like. By way of example and not limitation, when continued use of an exemplary elastic spool protector on a first spool is no longer desired, the elastic spool protector may be removed from the first spool, and may thereafter be positioned on a second spool.

Referring to FIGS. 2-3 and 7-8, various views of an exemplary elastic spool protector 10 independent of a flange are shown. A curved rim portion of the spool protector 10 may form an outer extent of a disk-shaped member. The rim portion may include a flange grip portion (lip portion 28) and a perimeter portion 22, but such is not necessarily required. The lip portion 28 may extend from the perimeter portion 22 for a distance over a rear portion 26 of the disk-shaped member. Specifically, the lip portion 28 may extend from the perimeter portion 22 to a lip edge 30. In the FIG. 3 embodiment, the lip portion 28 extends approximately 0.5 inches from the perimeter portion 22 to the lip edge 30, but such is not necessarily required in other embodiments. Certain other exemplary embodiments may include a lip portion extending anywhere between 0.2 inches to 2 inches over the rear portion of the disk-shaped member, but the aforementioned range is also not necessarily required. Here, the lip portion 28, similar to the perimeter portion 22, is substantially curved. It will be apparent to one of ordinary skill in the art that the thickness, shape, rigidity, size, some combination thereof, or the like of an exemplary elastic wire reel protector and components thereof (e.g., lip portion 28) may be varied without necessarily departing from the scope of the present invention.

An amount of space (referred to herein as a "receptacle") may be present between the lip portion 28 and the rear portion 26 of the elastic spool protector 10. The receptacle may be configured to receive an outer portion of a flange (not shown). The receptacle width may be varied to accommodate any number of different flange widths. The elastic spool protector 10 may be stretched to accommodate various flange sizes. A front portion 20 of the disk-shaped member may be positioned opposite of the rear portion 26, and the front portion 20 and rear portion 26 (e.g., collectively forming a "main portion" of the spool protector 10) may be substantially similar in shape and size. A thickness of the main portion (said thickness extending between the front portion 20 and the rear portion 26) may be varied without departing from the scope of the present invention. In the FIG. 2 embodiment, the thickness is approximately ¼ of an inch, but such is not necessarily required in other embodiments. An aperture (e.g., center opening 24) may be included at a central portion of the spool protector 10. It will be apparent to one of ordinary skill in the art that the particular shape, location and/or size of the aperture may be varied to, e.g., accommodate any number of different wire reels or like devices.

Figure 4:
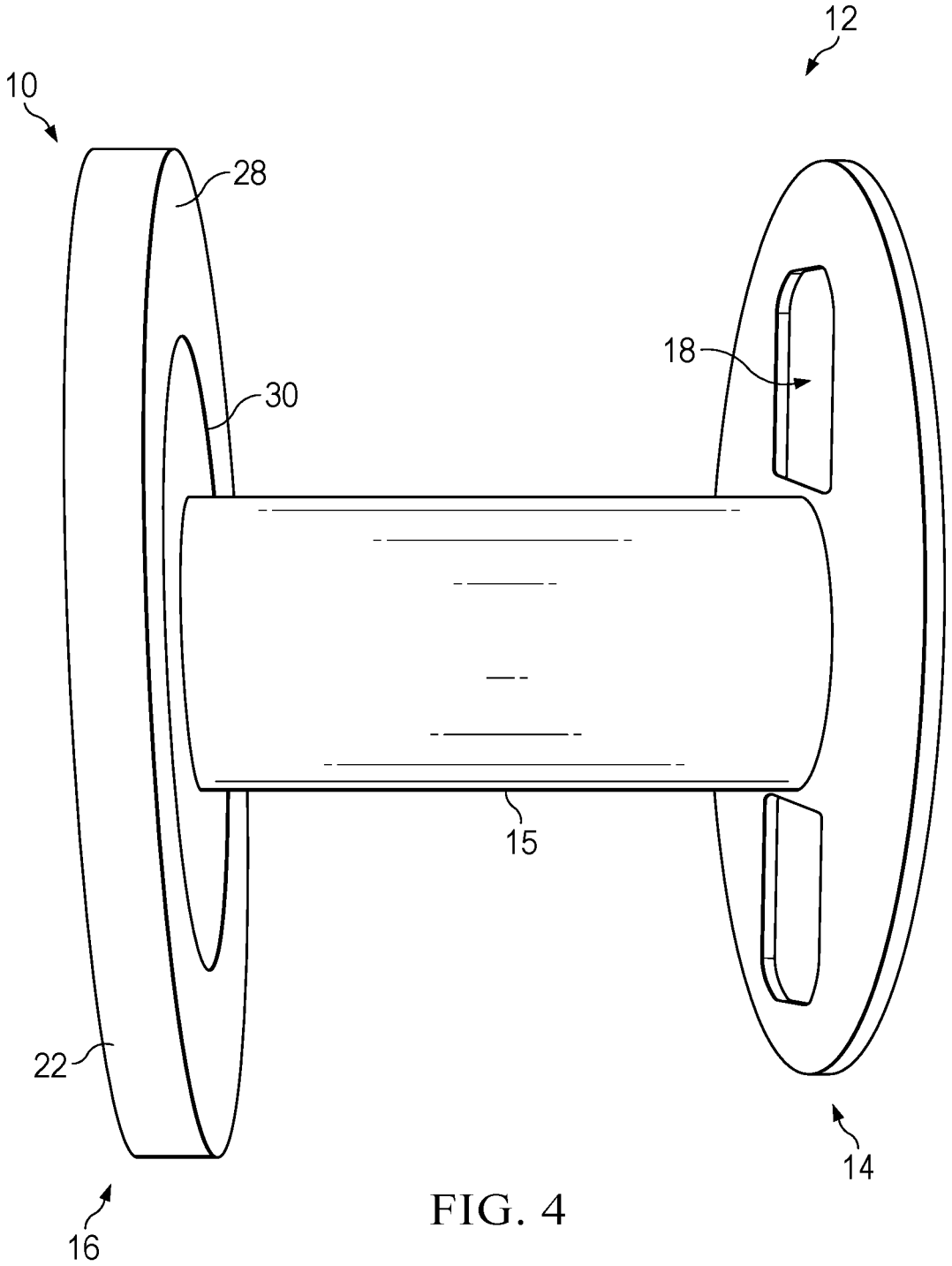
FIG. 4 is a side perspective view of the exemplary elastic spool protector of the FIG. 2 embodiment positioned on a wire reel in accordance with an exemplary embodiment of the present invention.
Figure 5:
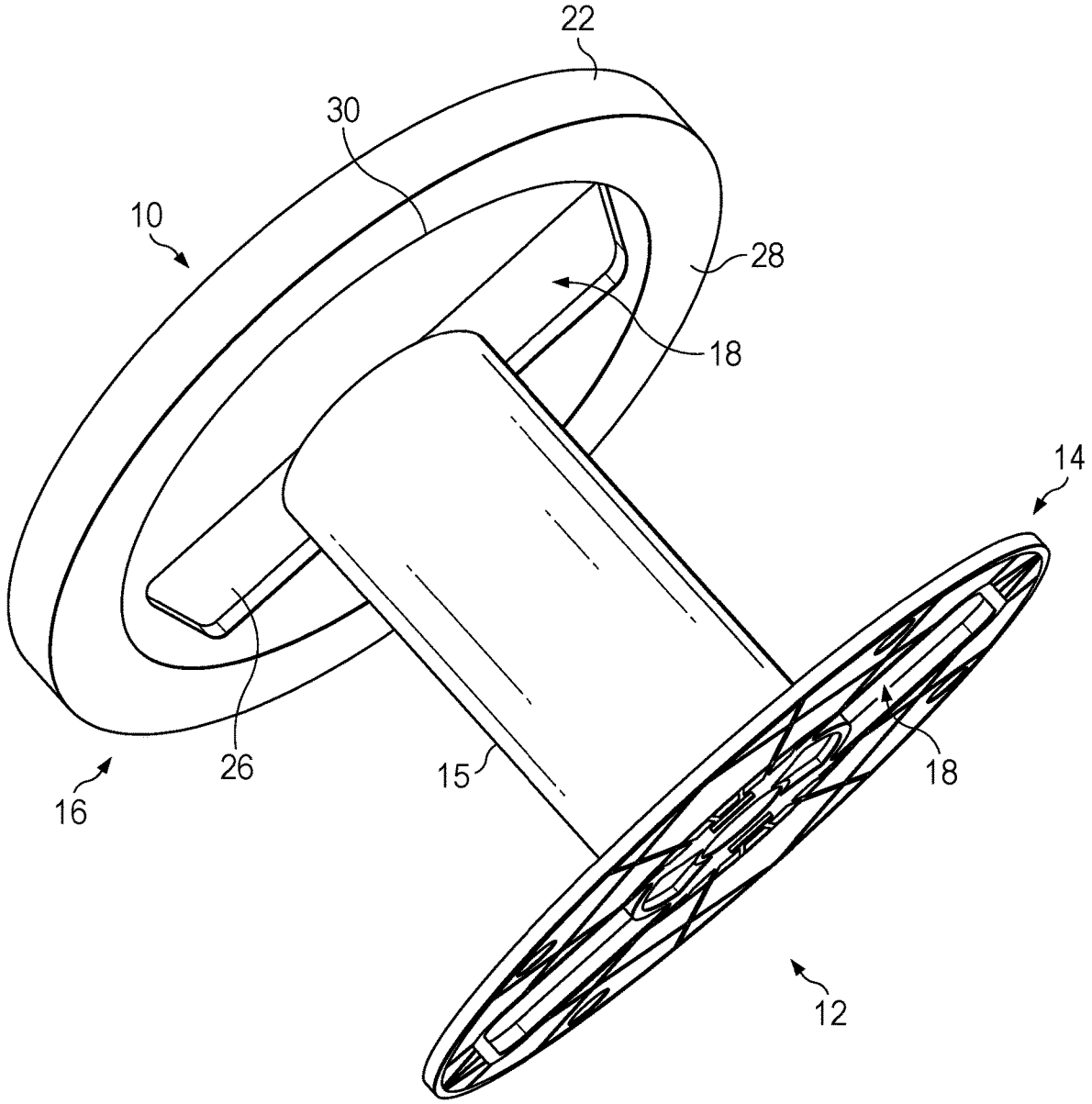
FIG. 5 is another perspective view of the FIG. 4 embodiment.
Figure 6:
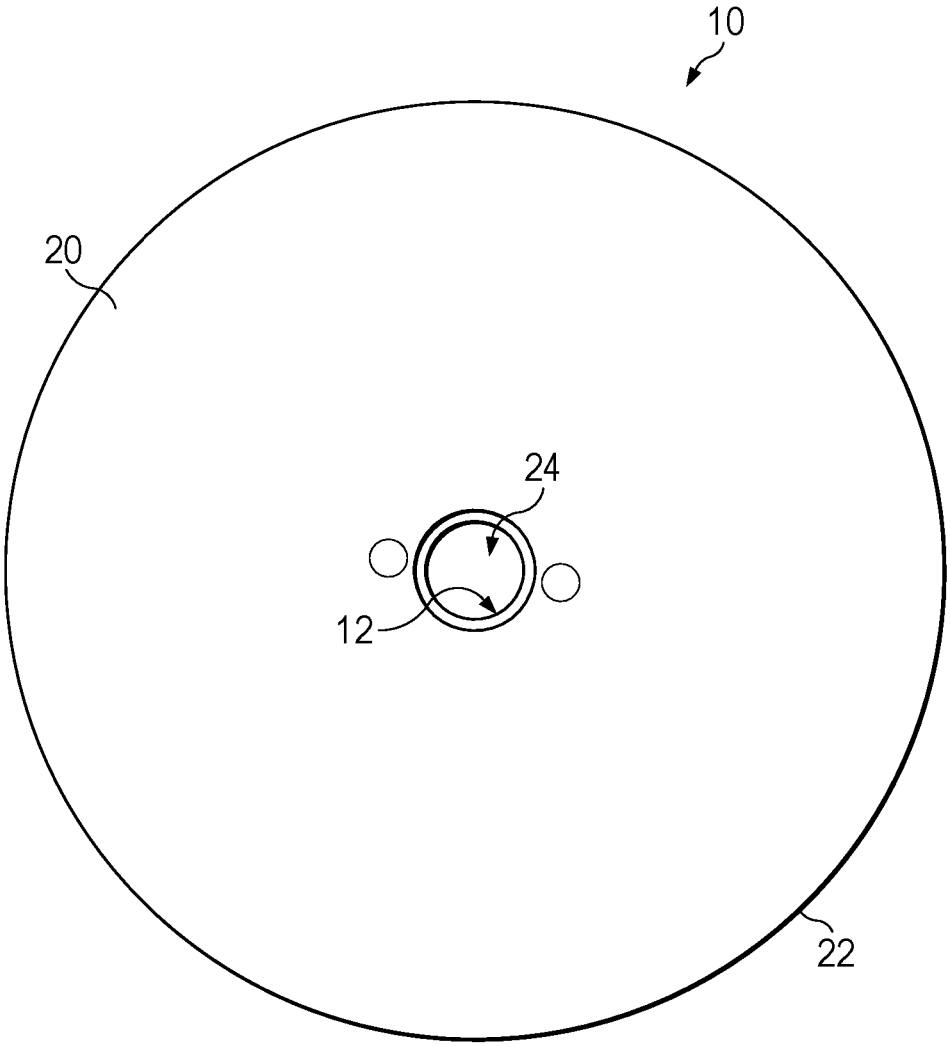
FIG. 6 is a front view of the FIG. 4 embodiment.
Figure 7:
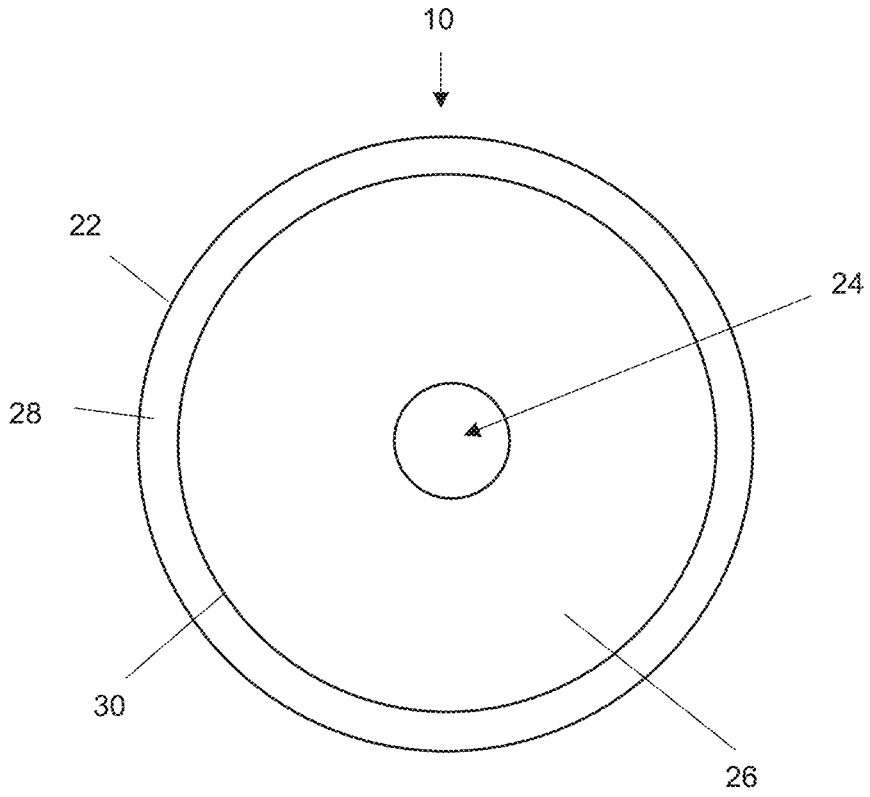
FIG. 7 is a rear view of an exemplary elastic spool protector in accordance with an exemplary embodiment of the present invention.
Figure 8:
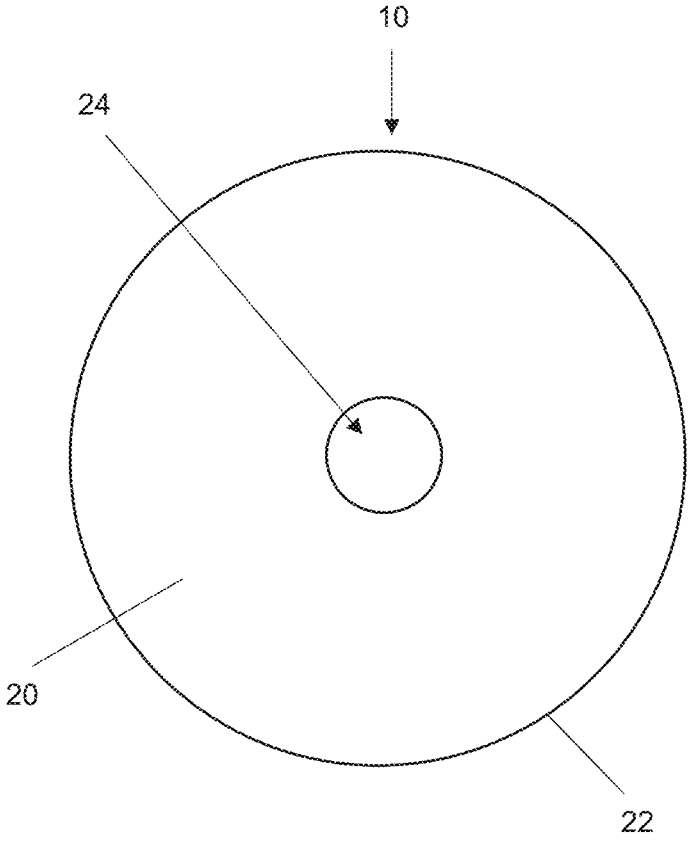
FIG. 8 is a front view of the exemplary elastic spool protector of the FIG. 7 embodiment.

Referring to FIGS. 4-6, an exemplary spool protector 10 may be positioned on either flange 14, 16 (on either side of a spool drum 15) of a wire reel 12. The spool protector 10 may reinforce a thin, outer portion of the flange 14, 16 between a perimeter of the flange 14, 16 and an aperture 18 in the flange 14, 16. A curved rim portion of the spool protector 10 may extend around an entire perimeter of the spool protector 10, and may be configured to fit over the flange (e.g., 16). In this particular embodiment, the rim portion includes a lip portion 28 and a perimeter portion 22 positioned substantially perpendicular to the lip portion 28. It will be apparent to one of ordinary skill in the art, however, that the particular number of surfaces, and shapes, sizes, and positions thereof defining an exemplary rim portion may be varied to accommodate any number of different flanges without necessarily departing from the scope of the present invention.

The lip portion 28 of the spool protector 10 may extend from the perimeter portion 22 to a lip edge 30. The lip portion 28 may contact and reinforce an outer portion of an inside face of the flange 16. The outer portion of the flange 16 may be poisoned in a receptacle between the lip portion 28 and a rear portion of the spool protector 10. The perimeter of the flange 16 may contact the perimeter portion 22 of the spool protector 10 across an entire circumference of the flange 16. The spool protector 10 may be stretched for the rim portion thereof to be positioned around the flange 16, and may constrict thereafter to be secured to the flange 16. The spool protector 10 may be positioned to substantially avoid contact with wire and/or other material to be wound to or unwound from the spool drum 15 (e.g., to prevent obstruction to said wire and/or other material).

The lip portion 28 may extend approximately 0.5 inches from the perimeter portion 22 to the lip edge 30 thereof, although such is not required. In the aforementioned non-limiting example, the lip portion 28 substantially covers 0.5 inches of an outer portion of the flange 16 (0.5 inches of the outer portion of the flange 16 are positioned in the receptacle). It will be apparent to one of ordinary skill in the art that lip portion length may be varied (e.g., to accommodate different amounts of wire or other material proximate to the drum) without departing from the scope of the present invention. The receptacle is preferably narrow enough to promote substantial immobilization of the spool protector 10 over the flange 16. The elastic spool protector 10 may absorb forces directed to the flange 16 to protect the flange 16 from impact damage, may maintain proper positioning of the flange 16 to prevent the flange 16 from bending, cracking, breaking, some combination thereof, or the like, may reinforce broken and/or cracked portions of the flange 16, some combination thereof, or the like.

A front portion 20 of the spool protector 10 may be positioned opposite of a rear portion 26 of the spool protector 10. The rear portion 26 may substantially cover an outside face of the flange 16, such that both the outside face of the flange 16 and the perimeter of the flange 16 are each substantially covered by the elastic spool protector 10. A center opening 24 of the elastic spool protector 10 may be configured to receive an arbor (axle, spindle, or the like) of the wire reel 12. The center opening 24 may also permit air to escape from the rear portion 26 of the elastic spool protector 10 to permit the elastic spool protector 10 to maintain high friction contact across an entire surface of the outside face of the flange 16 (e.g., without having air pockets form between the outside face of the flange 16 and the rear portion 26 of the elastic spool protector 10). The elastic spool protector 10 may comprise 3D-printed material (e.g., where 3D-printing is controlled by a computer-implemented additive manufacturing program), although such is not required. It will be apparent to one of ordinary skill in the art that any number of different techniques for assembling an exemplary elastic spool protector may be employed without necessarily departing from the scope of the present invention.

Figure 9:
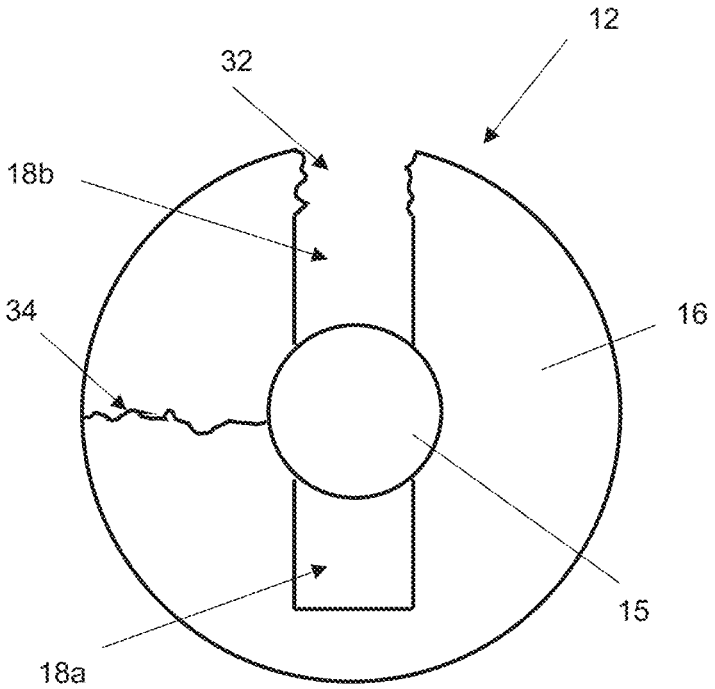
FIG. 9 is a front view of a damaged wire reel in accordance with an exemplary embodiment of the present invention.
Figure 10:
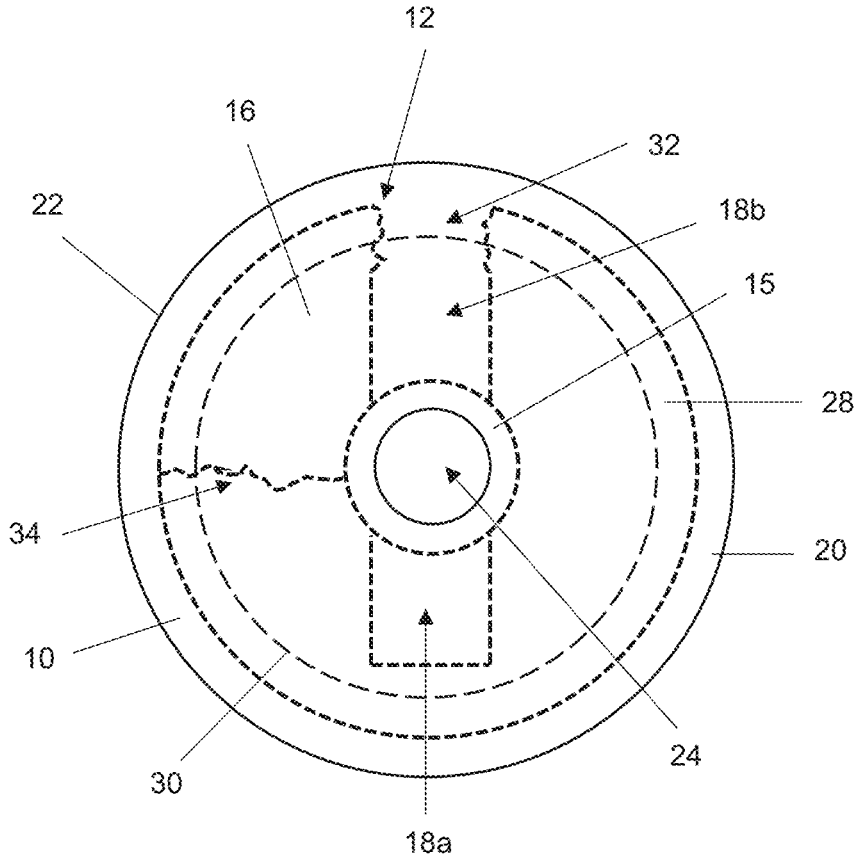
FIG. 10 is a schematic front view of an exemplary elastic spool protector positioned on the damaged wire reel of the FIG. 9 embodiment.

Referring now to FIGS. 9-10, a wire reel 12 having two apertures 18*a-b* in a flange 16 thereof is shown, where the flange 16 is connected to a spool drum 15. In this particular embodiment, a crack 34 is present on the flange 16, and a portion 32 of the flange 16 edge region between an aperture 18*b* and a perimeter of the flange 16 is shown having been broken off from the flange (e.g., by impact damage to an unprotected flange). Referring specifically to FIG. 10, an exemplary elastic spool protector 10 may be positioned around the edge region of the flange 16. Specifically, a rear portion of the spool protector 10 may substantially cover an outside face of the flange 16, and a lip portion 28 of the spool protector 10 may extend from a perimeter portion 22 of the spool protector 10 to a lip edge 30 thereof. The lip portion 28, perimeter portion 22 and the rear portion of the wire reel protector 10 may collectively contact and reinforce the flange 16, including damaged portions 32, 34 thereof.

A front portion 20 of the elastic spool protector 10 may protect the flange 16 from impact damage. The front portion 20 may surround a center opening 24 adapted to receive an arbor of the wire reel 12 (e.g., the arbor may extend through the spool drum 15). The spool protector 10 may securely constrict around the flange 16 to cover and reinforce damaged portions 32, 34 thereof. It will be apparent to one of ordinary skill in the art that an exemplary spool protector may permit continued use of any number of different damaged flanges or like components of a wire reel. It will also be apparent to one of ordinary skill in the art that an exemplary embodiment is not necessarily limited to use with a wire reel, and may be employed to protect other similar objects without departing from the scope of the present invention.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A wire reel spool protector, comprising:

a substantially disk-shaped first portion;

a substantially disc-shaped second portion, configured to be positioned parallel to said first portion to define a space between said first and second portions capable of receiving an outer extent of a flange of a wire reel spool;

a curved perimeter ring extending from an outermost circumferential edge of said first portion to an outermost circumferential edge of said second portion, and configured to be positioned perpendicular to each of said first and second portions;

wherein said curved perimeter ring is configured to cover an outer edge circumference of said flange of said wire reel spool;

wherein said first portion is configured to extend along and cover at least part of an outside face of said flange, and said second portion is configured to extend along and cover at least part of an inside face of said flange; and wherein said first and second portions and said curved perimeter ring comprise elastomeric material, are separate from said flange, and are configured to be removed from said flange without affecting the structure of said flange.

2. The device of claim 1, wherein said first portion comprises a center opening configured to receive an arbor of said wire reel spool.

3. The device of claim 1, wherein said second portion is a fraction of the size of said first portion, and is adapted to avoid contact with wire surrounding a spool drum proximate to said flange.

4. The device of claim 3, wherein said first and second portions and said perimeter ring are each capable of covering and reinforcing damaged portions of said flange.

* * * * *